US011835060B2

(12) United States Patent
Jiang et al.

(10) Patent No.: US 11,835,060 B2
(45) Date of Patent: Dec. 5, 2023

(54) RANGE HOOD

(71) Applicant: NINGBO FOTILE KITCHEN WARE CO., LTD., Zhejiang (CN)

(72) Inventors: Yi Jiang, Zhejiang (CN); Zhineng Xu, Zhejiang (CN); Gai Lei, Zhejiang (CN); Lei Shi, Zhejiang (CN); Wenbo Gou, Zhejiang (CN)

(73) Assignee: NINGBO FOTILE KITCHEN WARE CO., LTD., Zhejiang (CN)

( * ) Notice: Subject to any disclaimer, the term of this patent is extended or adjusted under 35 U.S.C. 154(b) by 0 days.

(21) Appl. No.: 17/769,336

(22) PCT Filed: Oct. 30, 2020

(86) PCT No.: PCT/CN2020/125217
§ 371 (c)(1),
(2) Date: Apr. 15, 2022

(87) PCT Pub. No.: WO2022/082847
PCT Pub. Date: Apr. 28, 2022

(65) Prior Publication Data

US 2023/0151820 A1 May 18, 2023

(30) Foreign Application Priority Data

Oct. 20, 2020 (CN) ..... 202011124142.0

(51) Int. Cl.
*F04D 29/42* (2006.01)
*F24C 15/20* (2006.01)

(52) U.S. Cl.
CPC ..... *F04D 29/4226* (2013.01); *F04D 29/4213* (2013.01); *F24C 15/20* (2013.01)

(58) Field of Classification Search
CPC .. F04D 29/4226; F04D 29/4213; F04D 29/28; F04D 29/04; F24C 15/20
See application file for complete search history.

(56) References Cited

U.S. PATENT DOCUMENTS

2008/0193284 A1* 8/2008 Hoeffken ..... F04D 29/4226 415/203
2019/0360701 A1* 11/2019 Xu ..... F24C 15/20

FOREIGN PATENT DOCUMENTS

CA 2581241 C * 4/2014 ..... F24F 13/082
CN 2679405 2/2005
CN 103512065 A * 1/2014
CN 103697513 4/2014
(Continued)

OTHER PUBLICATIONS

Translation CA-2581241-C (Year: 2023).*
(Continued)

*Primary Examiner* — J. Todd Newton
(74) *Attorney, Agent, or Firm* — JCIPRNET

(57) ABSTRACT

A range hood, includes a fan system (2), the fan system (2) having a volute (21) and an impeller (22); the volute (21) includes a front cover (211), a rear cover (212) and an annular wall (213); the annular wall (213) has a volute tongue (214); the front cover (211) has an air inlet (215), the air inlet (215) faces downward to make the range hood to be a horizontal range hood; the volute tongue (214) is gradually inclined from the rear cover (212) to the front cover (211) in a direction opposite to the rotation direction of the impeller (22).

12 Claims, 10 Drawing Sheets

(56) References Cited

FOREIGN PATENT DOCUMENTS

| | | | | |
|---|---|---|---|---|
| CN | 103742453 | | | 4/2014 |
| CN | 103742453 | A | * | 4/2014 |
| CN | 203730405 | | | 7/2014 |
| CN | 104005996 | | | 8/2014 |
| CN | 104005996 | A | * | 8/2014 |
| CN | 203906394 | | | 10/2014 |
| CN | 203906394 | U | * | 10/2014 |
| CN | 104196761 | A | * | 12/2014 |
| CN | 104454647 | A | * | 3/2015 |
| CN | 105257598 | | | 1/2016 |
| CN | 105673567 | | | 6/2016 |
| CN | 207006315 | | | 2/2018 |
| CN | 208886871 | U | * | 5/2019 |
| FR | 2875560 | | | 12/2006 |

OTHER PUBLICATIONS

Translation CN-103512065-A (Year: 2023).*
Translation CN-103742453-A (Year: 2023).*
Translation CN-104005996-A (Year: 2023).*
Translation CN-104196761-A (Year: 2023).*
Translation CN-104454647-A (Year: 2023).*
Translation CN-203906394-U (Year: 2023).*
Translation CN-208886871-U (Year: 2023).*
"International Search Report (Form PCT/ISA/210) of PCT/CN2020/125217," dated Jul. 14, 2021, pp. 1-5.

* cited by examiner

RANGE HOOD

CROSS-REFERENCE TO RELATED APPLICATION

This application is a 371 of international application of PCT application serial no. PCT/CN2020/125217, filed on Oct. 30, 2020, which claims the priority benefit of China application no. 202011124142.0, filed on Oct. 20, 2020. The entirety of each of the above mentioned patent applications is hereby incorporated by reference herein and made a part of this specification.

TECHNICAL FIELD OF THE INVENTION

The present invention relates to an oil fume purification device, and in particular to a range hood.

BACKGROUND OF THE INVENTION

Range hoods have become one kind of indispensable kitchen appliances in modern families. Range hoods operate on the principle of fluid dynamics, suck and exhaust oil fume through centrifugal fans mounted inside the range hoods and filter some oil particles through filter screens. The centrifugal fan comprises a volute, an impeller disposed in the volute and a motor for driving the impeller to rotate. When the impeller rotates, a negative-pressure suction force is generated in the center of the fan, so that oil fume under the range hood is sucked into the fan, accelerated by the fan and then collected by the volute and guided to the outside.

At present, the range hood market has a plurality of horizontal range hoods. The range hoods are mainly characterized in that the fan system is disposed horizontally, the centrifugal fan system is generally used and the rotating shaft of the motor is vertical to the table of the cooker. For example, a Chinese Utility Model patent CN207006315U (patent NO.: 201720917014.9) disclosed an ultra-thin top-indrawing range hood, which at least comprises a housing and an air supply component, wherein the air supply component comprises a fan volute, a motor matched with the fan volute and an impeller; the fan volute comprises a front cover having an air inlet formed thereon and an middle annular wall; and the middle annular wall vertically connects the front cover by using a continuous smoothly-transited curved surface to form an inner flow passage opened upward and an air supply port.

Since the inner surface of the lower wall of the air inlet in the fan system is parallel to the rotating plane of the impeller, the lower wall is of a horizontal structure, resulting in the lack of a necessary flowing structure on the inner surface of the fan system. As a result, oil liquid is easy to accumulate on the inner surface of the lower wall, cannot be effectively collected and will drop into the stove or cooler. Short-term accumulation will make oil dirt deteriorate and give out peculiar smell, and long-term accumulation will also erode the lower wall.

It is a general solution, that a guiding mechanism is additionally disposed between the housing of the range hood and the fan system, so that oil liquid is guided to the rear of the range hood through the oil guiding mechanism, and an oil cup is disposed in the rear of the range hood to receive waste oil.

However, this solution has the following problems.

1) A very large space needs to be reserved inside the range hood to evade the guiding mechanism. Meanwhile, such range hoods generally have flat and thin appearance characteristics. The overall thickness in the vertical direction is generally small, and the size of the fan system is occupied by evading the guiding mechanism, so that the performance of the fan system is affected and the oil fume suction performance of the product is directly reduced.

2) Since the guiding mechanism is too horizontal and due to the high viscosity of the oil liquid, the actual fluidity is low, and wastes are easy to accumulate inside the range hood and difficult to flow out.

3) In practical applications, since there is a fitting relationship among many parts, there must be fit clearances, and excessive fit clearances increase the risk of oil leakage, increase air noise during suction and reduce the air volume of the whole machine, so that the oil fume suction effect of the whole machine is affected.

SUMMARY OF THE INVENTION

It is an object of the present invention to provide a range hood, which can ensure the performance of the existing fan systems and realize the collection of waste oil.

For achieving the above object, the range hood comprises a fan system having a volute and an impeller disposed inside the volute; wherein, the volute comprises a front cover, a rear cover and an annular wall connected between the front cover and the rear cover; the annular wall has a volute tongue; the front cover is located below the rear cover, the front cover has an air inlet, the air inlet faces downward to make the range hood to be a horizontal range hood; characterized in that the volute tongue is gradually inclined from the rear cover to the front cover in a direction opposite to the rotation direction of the impeller.

In order to further increase the flow rate by narrowing the passage between the volute tongue and the impeller so as to form a certain gas backflow to blow the oil liquid flowing to the air outlet from the inner side of the front cover of the volute to enter the passage and flow downward for collection, preferably, the intersection of the annular wall and the rear cover is defined as a first profile line of the volute, the intersection of the annular wall and the front cover is defined as a second profile line of the volute; an ending point of the profile line of the volute tongue in the first profile line is defined as A, a point corresponding to A in the second profile line is defined as B, an ending point of the profile line of the volute tongue in the second profile line is defined as C, and the line of BC is in arc-shape or is a reduced spline curve.

In order to avoid the interference with the impeller due to a too small distance between the volute tongue and the impeller, and the abnormal howling sound that may be caused by excessive gas backflow, preferably, any point between B and C has a radius of Rx, and $R2 \leq Rx \leq R1$, and $0.75 \leq R2/R1 \leq 1$.

In order to further avoid a too small distance between the volute tongue and the impeller so that the volute tongue is inclined within a proper range, preferably, the projections of center points of the first profile line and the second profile line in the axial direction of the impeller are O; an included angle θ is defined between the ligature BO and the ligature CO, and θ has a value range of 0° to 60°.

In order to conveniently guide an oil fume flow into the volute and avoid the leakage of oil fume, preferably, the range hood further comprises a housing having an opening bottom; wherein the fan system is disposed in the housing; an oil guide plate is disposed below the fan system to seal the bottom of the housing; a fume suction port is disposed at a position on the oil guide plate corresponding to the air inlet; a transition ring for guiding air flow into the air inlet of the volute is disposed at the fume suction port; and the transition ring extends into the volute from the air inlet.

In order further better guide the oil fume flow into the volute, preferably, the transition ring comprises an annular radial air guide portion extending in the radial direction of the edge of the fume suction port and an axial air guide portion extending from the radial inner side of the radial air guide portion to the volute in the axial direction of the impeller; and the axial air guide portion extends into the volute from the air inlet of the volute.

In order to conveniently enable the oil liquid reserved in the volute downward for collection, preferably, the radial air guide portion is cylindrical and gradually extends from the radial outer side to the radial inner side in a direction away from the volute and the longitudinal cross section is arc-shaped; the axial air guide portion axially extends into the volute from the lowest position of the radial air guide portion; and an oil dripping port is disposed on an annular surface at the lowest position of the transition ring.

In order to make an air flow smoothly pass by the oil dripping port in a parabolic form without being sucked into the oil dripping port to generate certain aerodynamic noise when the oil fume flow passes by the transition ring to enter the air inlet along the surface of the fan system from inside to outside, preferably, a convex arc-surface is formed on the radial outer side of the transition ring where the oil dripping port is disposed; an end of the arc-surface is connected to the oil dripping port; the arc-surface is gradually transited to be partly connected to the oil guide plate located on the edge of the fume suction port; and the end of the arc-surface connected to the oil dripping port is the lowest position of the whole arc-surface.

In order to conveniently guide the oil liquid downward, preferably, an air inlet ring is disposed at the air inlet on the front cover, and the air inlet ring extends inward radially from the edge of the air inlet and gradually extends toward the outside of the volute to form an inclined ring structure. In order to avoid the leakage of oil fume between the oil guide plate and the volute, preferably, an air inlet seal ring is disposed between the air inlet ring of the volute and the periphery of the oil guide plate located outside the fume suction port.

In order to expand the negative pressure region of the range hood so that the oil fume can smoothly flow into the fume suction port along the surface of the oil guide plate and thus form an air flow at a certain flow rate on the surface of the oil guide plate, and to avoid oil condensation on the surface of the oil guide plate, preferably, a fume guide plate is disposed below the oil guide plate, and the fume guide plate is disposed below the fume suction port.

In order to prevent the oil liquid dripping from the transition ring from dripping down to the cooking range, preferably, the periphery of the projection of the fume guide plate on the horizontal plane is located on the periphery of the projection of the transition ring of the oil guide plate on the horizontal plane.

Preferably, in order to facilitate the fume guide plate to receive oil liquid so as to collect the oil liquid, the fume guide plate is gradually inclined downward from front to rear, and the rear side of the fume guide plate is protruded downward to form an oil collection groove.

Preferably, in order to facilitate the further collection of oil liquid, the left, right and front side edges of the fume guide plate have a plurality of upward flanges.

Compared with the prior art, the present invention has the following advantages. In the present invention, the volute tongue is inclined in a direction opposite to the rotation direction of the impeller, the flow rate can be increased by narrowing the passage between the volute tongue and the impeller, so that a certain gas backflow is formed to blow the oil liquid flowing to the air outlet from the inner side of the front cover of the volute to enter the passage and flow downward for collection.

In order to enable the oil liquid flowing from the volute to flow downward for collection, an oil dripping port is formed at the lowest position of the transition ring of the oil guide plate, so that the oil liquid flowing from the volute gathers at the oil dripping port and then flows downward.

A fume guide plate is disposed below the oil guide plate, an interlayer is formed between the fume guide plate and the oil guide plate, therefore the negative pressure region is expanded, and an air flow at a certain flow rate is formed on the surface of the oil guide plate, thereby avoiding the oil condensation on the surface of the oil guide plate.

The fume guide plate is shaped as a container, and can collect oil liquid while guiding fume.

By integrating the transition ring with the oil guide plate and disposing an air inlet seal ring between the oil guide plate and the volute, the whole machine is sealed, the flow field of the gas is ensured, unnecessary leakage is reduced, and the oil fume suction efficiency is improved.

In the range hood of the present invention, the guidance and collection of oil liquid can be realized without additionally disposing a separate oil guiding mechanism between the housing of the range hood and the fan system, so that a larger space is provided for the fan system, and the oil fume suction effect will not be negatively affected.

DETAILED DESCRIPTION OF THE EMBODIMENTS

Figure 1:
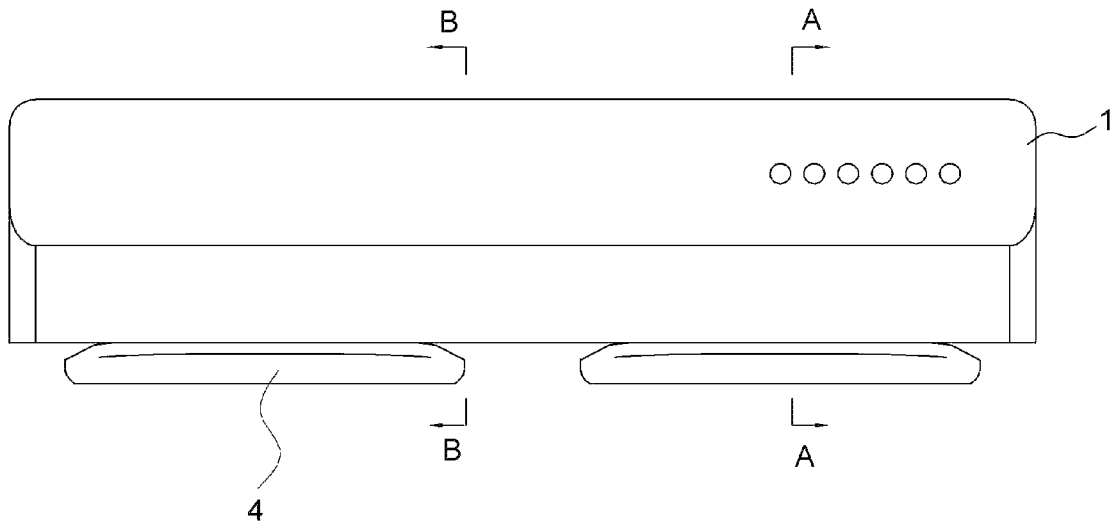
FIG. 1 is a perspective view of a range hood according to an embodiment of the present invention.
Figure 2:
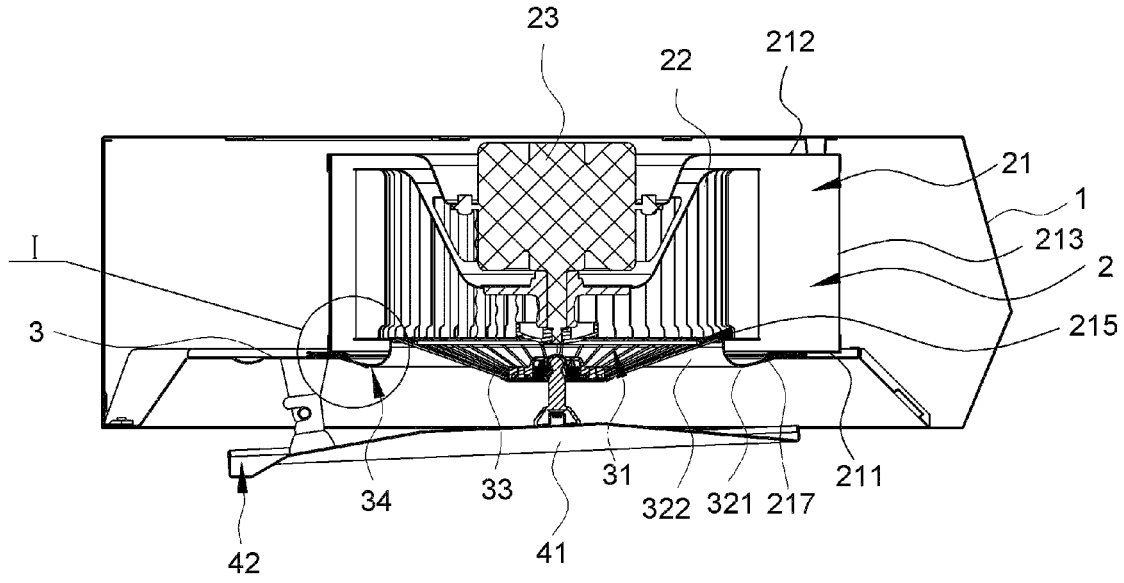
FIG. 2 is a sectional view of FIG. 1 along A-A.
Figure 3:
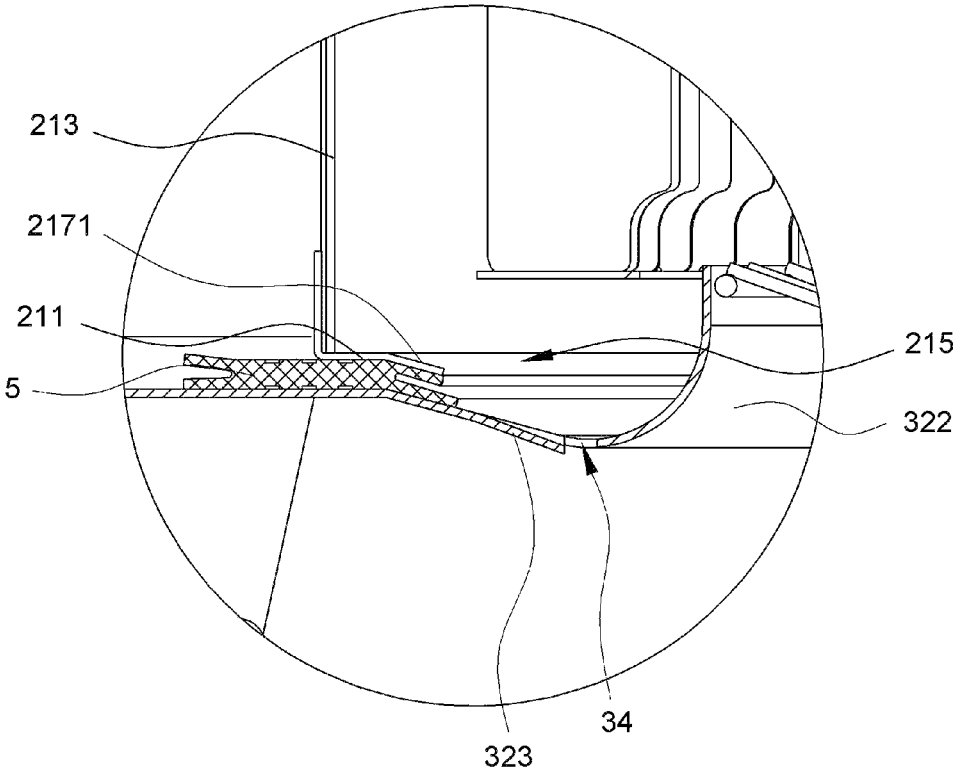
FIG. 3 is an enlarged view of Part-I of FIG. 2.

The embodiments of the present invention will be described below in detail. The examples of these embodiments have been illustrated in the accompanying drawings throughout which like or similar reference numerals indicate like or similar elements or elements having like or similar functions.

It is to be noted that, in the description of this embodiment, orientations or location relationships indicated by terms such as "center", "lengthways", "transverse", "length", "width", "thickness", "up", "down", "front", "rear", "left", "right", "vertical", "horizontal", "top", "bottom", "inside", "outside", "clockwise", "anticlockwise", "axial", "radial", "circumference" are the orientations and location relationships illustrated on the basis of the accompany drawings. Such terms are used just for ease of describing the present invention and simplifying the description, and it is not indicated or implied that the stated device or element must have a specific orientation or must be constructed and operated in the specific orientation, the embodiment of the present invention can be set in different directions, and shall not be interpreted as any limitation to the present invention. For example, "up" and "down" are not always limited to directions opposite or consistent with the direction of gravity. In addition, features that qualify as "first" or "second" may comprise, explicitly or implicitly, one or more of these features.

FIGS. 1-6 show a preferred embodiment of a range hood according to the present invention. The range hood is a horizontal range hood, and comprises a housing 1, a plurality of fan systems 2 disposed in the housing 1, an oil guide plate 3, a fume guide plate component 4 and an air inlet seal ring 5.

The fan systems 2 are centrifugal fans, and each fan system comprises a volute 21, an impeller 22 disposed inside the volute 21 and a motor 23 for driving the impeller 22 to rotate. In this embodiment, there are two fan systems 2 disposed in parallel. The impeller 22 is connected to an output shaft of the motor 23 through a hand-tightened nut 221.

Each volute 21 comprises a front cover 211, a rear cover 212 and an annular wall 213 connected between the front cover 211 and the rear cover 212.

The front cover 211 is located below the rear cover 212, and the front cover 211 and the rear cover 212 are spaced part in the up-down direction and disposed in parallel. The front cover 211 has an air inlet 215, and the air inlet 215 faces downward to make the range hood to be a horizontal range hood.

The annular wall 213 has an opening to form a first end 213*a* and a second end 213*b*. The annular wall 213 extends outward from the first end 213*a* and the second end 213*b* to respectively form a first extension wall 213*c* and a second extension wall 213*d*. The front cover 211, the rear cover 212 and the first extension wall 213*c* and the second extension wall 213*d* form an air outlet 216. In this embodiment, the left and right fan systems 2 shares one second extension wall 213*d*.

A volute tongue 214 is disposed at the first end 213*a* of the annular wall 213, and the volute tongue 214 has a C-shaped cross-section and is respectively connected to the first end 213*a* of the annular wall 213 and the first extension wall 213*c*. That is, the first end 213*a* of the annular wall 213 extends outward at this turn (the volute tongue). Thus, the volute tongue 214 separates the air flow driven by the impeller 22 to the air outlet 216, thereby preventing most of the gas from flowing back to the volute 21 and achieving the purpose of discharging oil fume. The air inlet 215 and the air outlet 216 are the air inlet and air outlet of the range hood.

In order to facilitate the connection to a fume discharge pipe, in the horizontal range hood, a fan air outlet is generally disposed on the rear cover 212 of the volute 21, so that the air flow originally flowing from the air outlet 216 of the range hood makes a 90° turn and is then discharged upward. A volute seal gasket 218 can be disposed between the rear cover 211 of the volute 21 and the top of the inner side of the housing 1.

In the horizontal range hood, the front cover 211 and the rear cover 212 are planar structures. Firstly, by using the basic characteristics of the centrifugal fan, when gas enters the fan system 2, with the rotation of the impeller 22, the oil liquid separated by the impeller 22 will be spun to the annular wall 213, the front cover 211 and the rear cover 212 of the volute 21, mainly to the annular wall 213. In addition, due to the gravity and the rotation of the impeller 22, the oil liquid is inclined downward to the inner side of the front cover 211. Meanwhile, due to the rotation of the impeller 22, the oil liquid flows to the air outlet 216 in the rotation direction of the impeller 22.

An air inlet ring 217 is disposed at the air inlet 215 on the front cover 211, and the air inlet ring 217 extends inward radially from the edge of the air inlet 215 and gradually extends toward the outside of the volute 21 to form an inclined ring structure.

Figure 4:
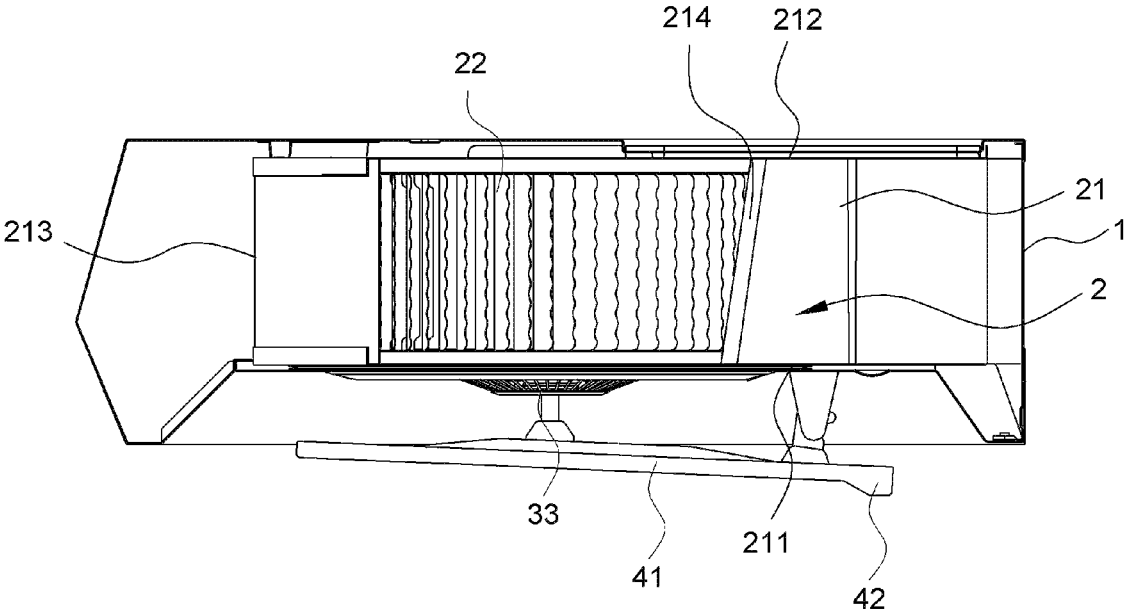
FIG. 4 is a sectional view of FIG. 1 along B-B.
Figure 7:
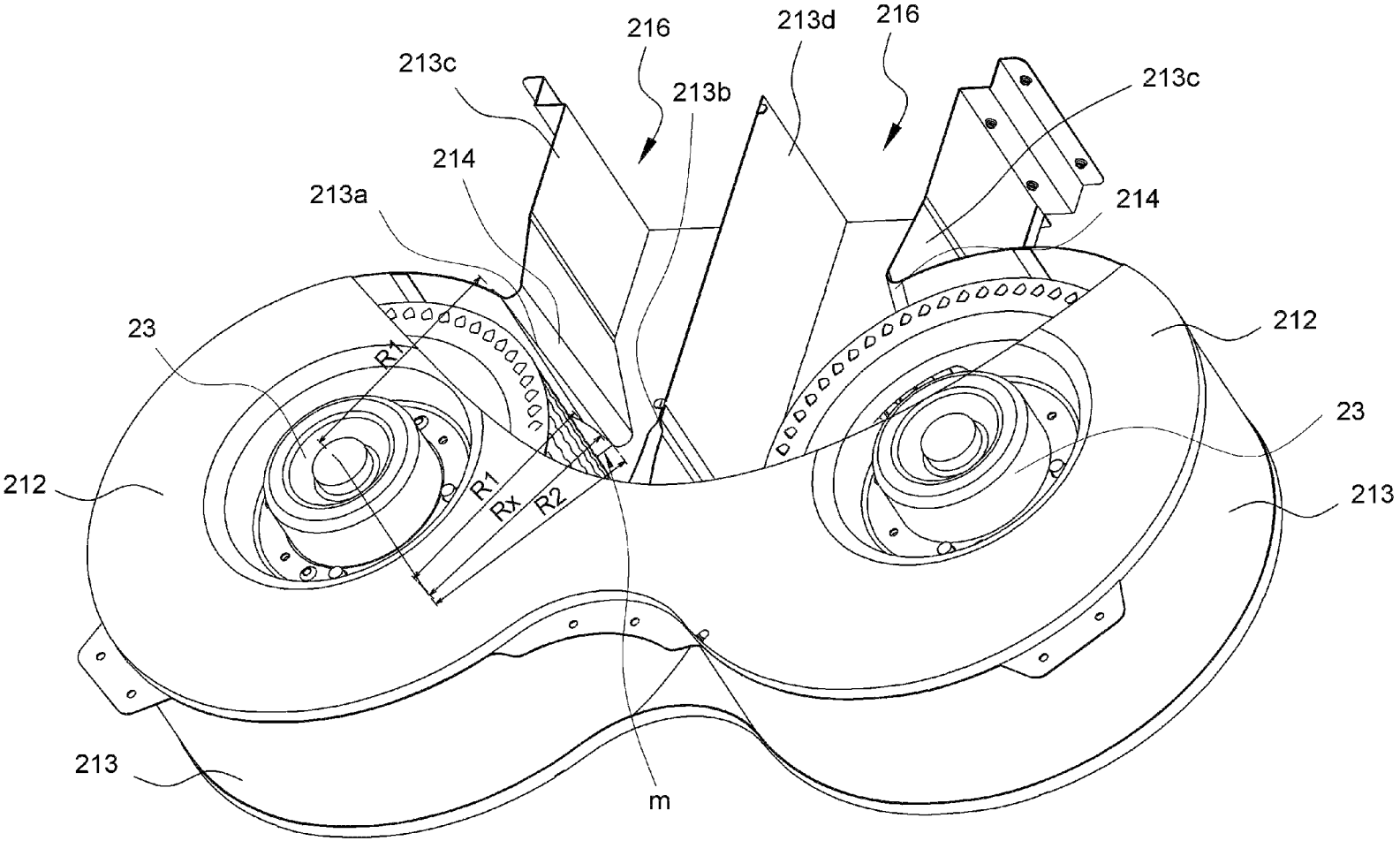
FIG. 7 is a perspective view of the fan system of the range hood after a part of a rear cover is omitted according to the embodiment of the present invention.
Figure 8:
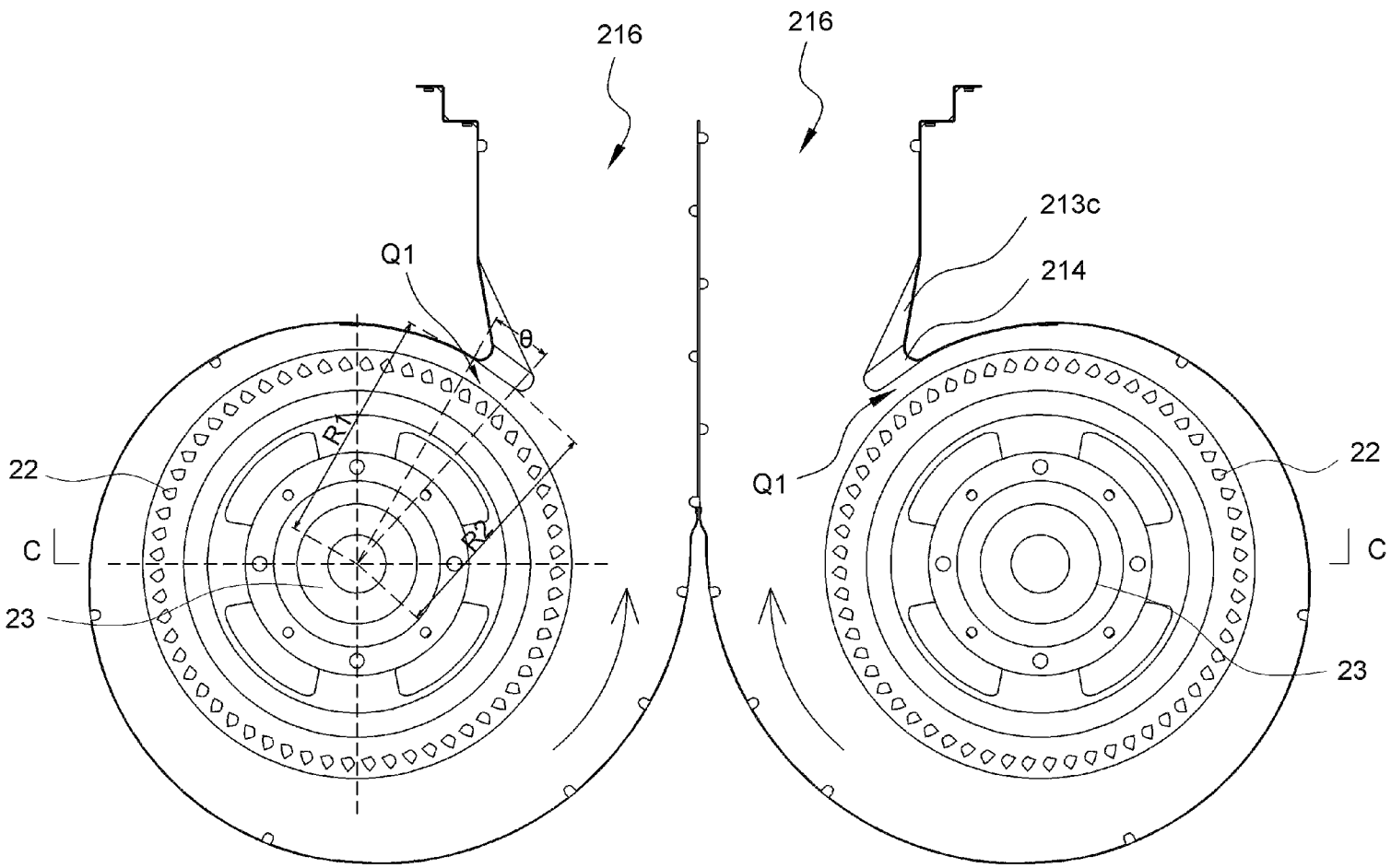
FIG. 8 is a top view of the fan system of the range hood according to the embodiment of the present invention (the front cover and the rear cover of the volute are omitted)
Figure 9:
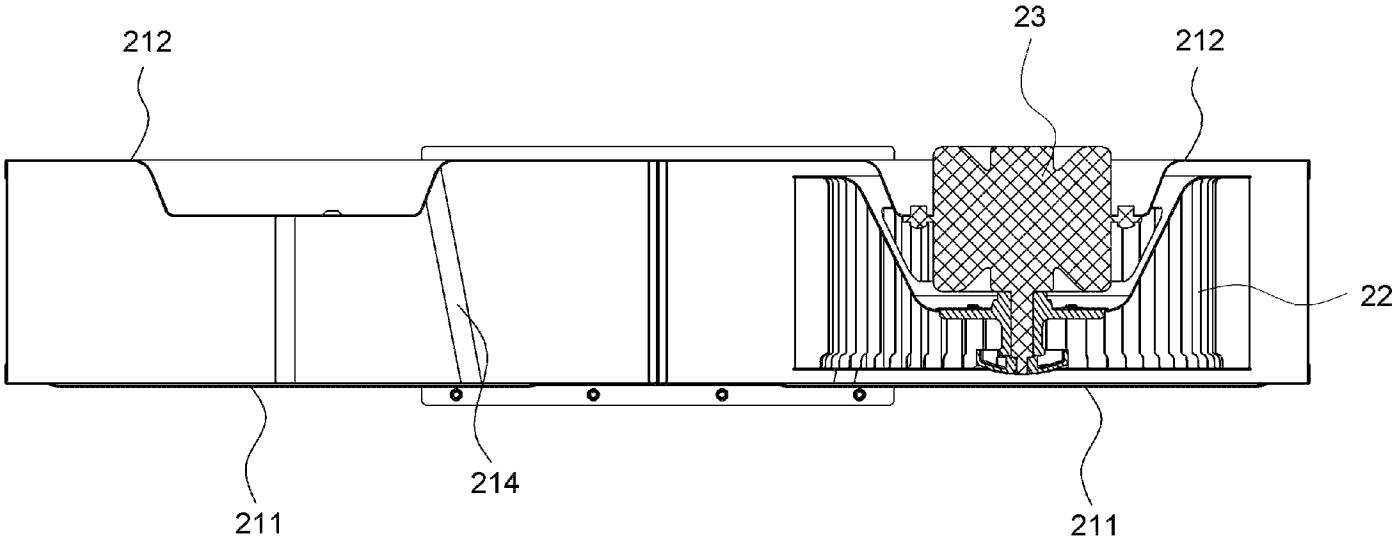
FIG. 9 is a sectional view of FIG. 7 along C-C (the impeller and the motor of the fan on one side are omitted)
Figure 10:
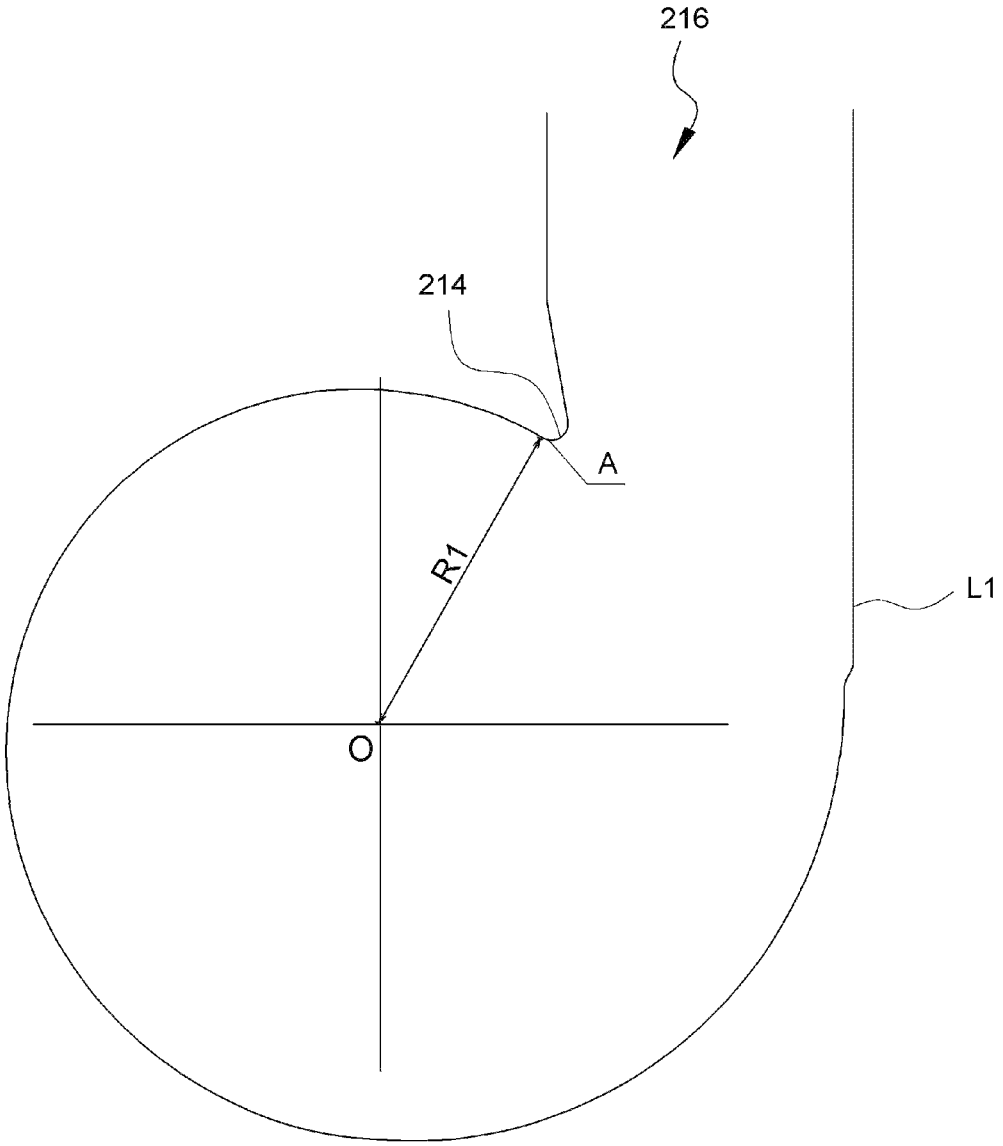
FIG. 10 is a schematic diagram of a first profile line of the volute of the fan system of the range hood according to the embodiment of the present invention.
Figure 11:
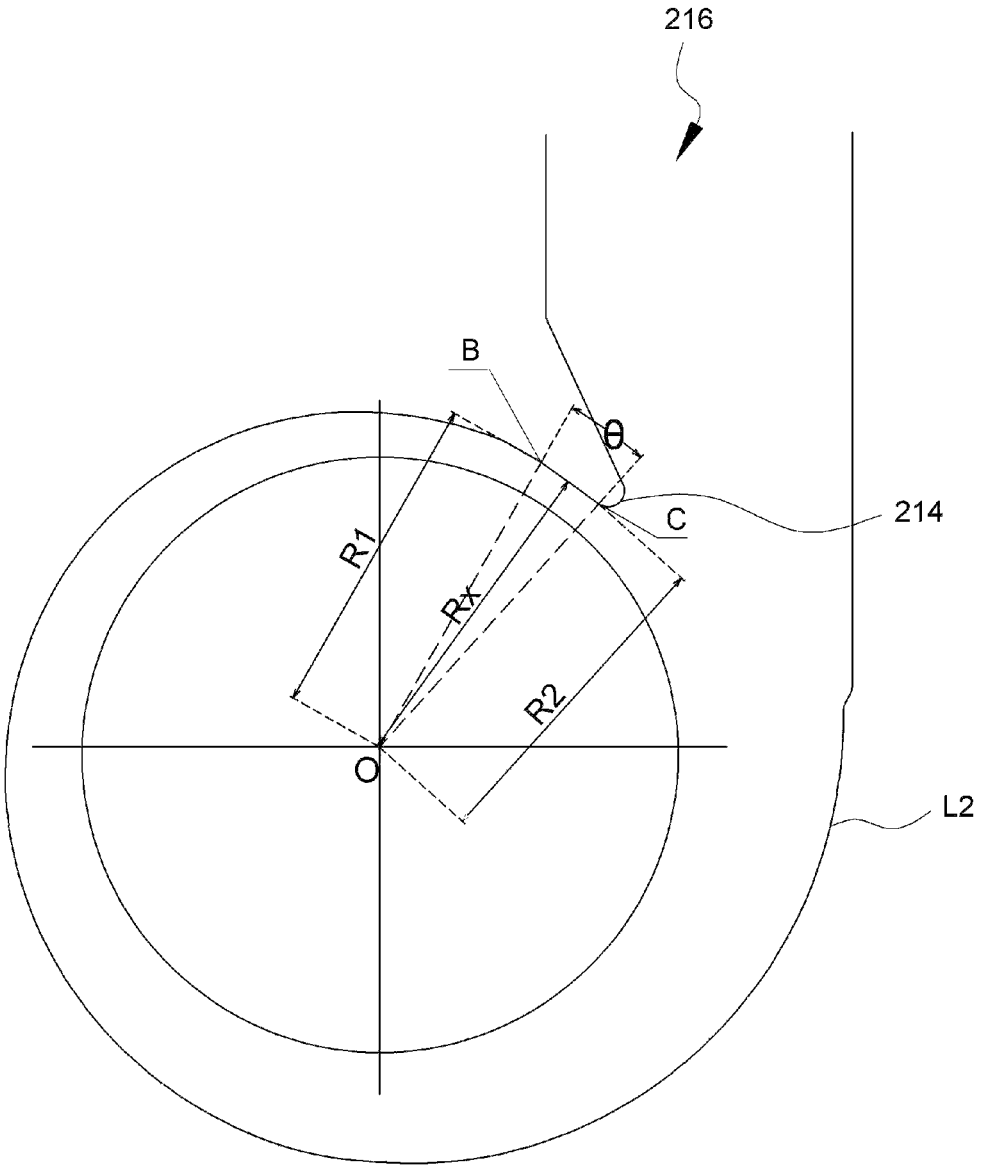
FIG. 11 is a schematic diagram of a second profile line of the volute of the fan system of the range hood according to the embodiment of the present invention.
Figure 12:
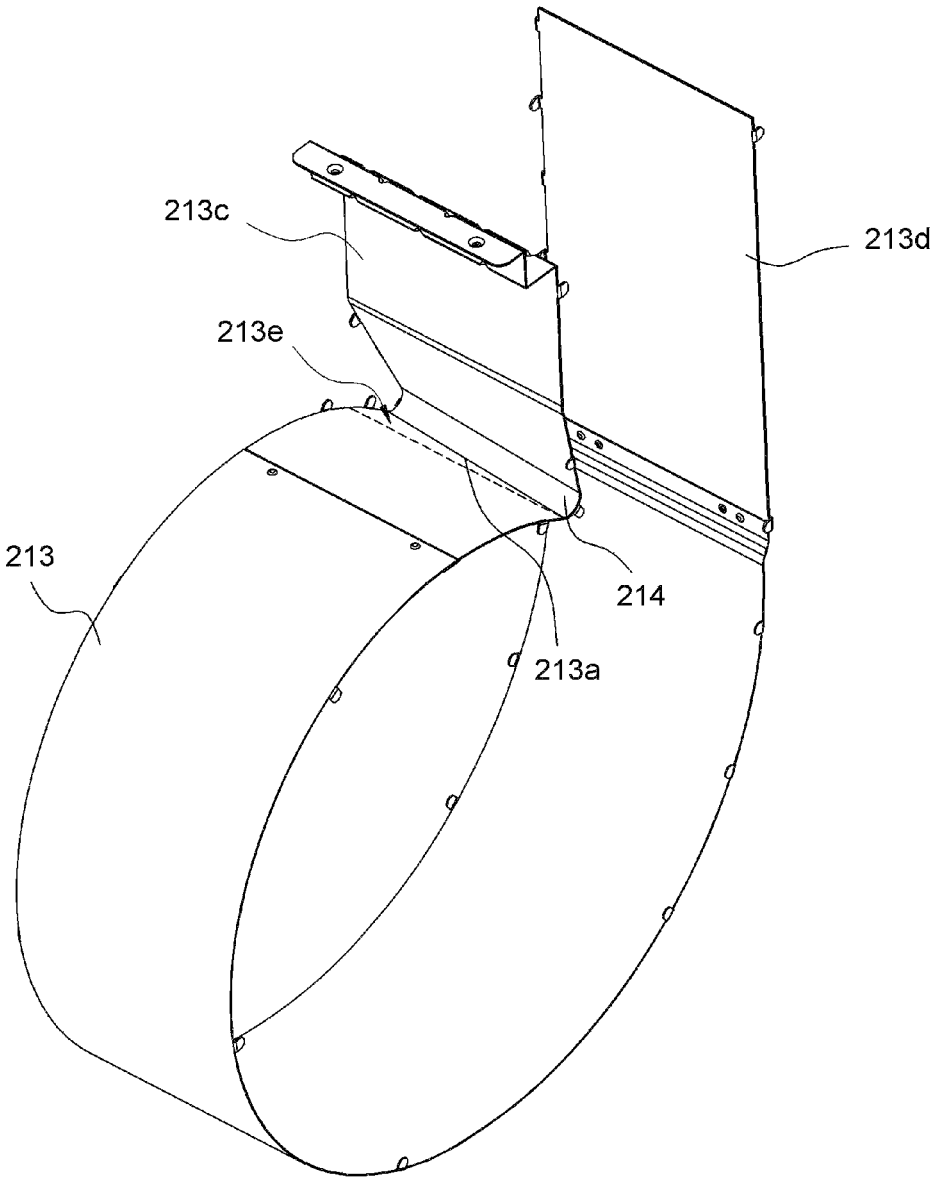
FIG. 12 is a perspective view of the annular wall in the range hood according to the embodiment of the present invention.

In a general centrifugal fan, any profile line of the volute in the axial direction of the impeller 22 (the annular wall 213, the volute tongue 214 and the profile lines of the first extension wall 213*c* and the second extension wall 213*d*) is consistent in shape, wherein the starting point of the volute profile line is the end of the air outlet 216 of the volute 21 close to the volute tongue 214 (that is, the tail end of the first extension wall 213*c*), and the ending point of the volute profile line is the end of the air outlet 216 of the volute 21 away from the volute tongue 214 (that is, the tail end of the second extension wall 213*d*). This definition mode is the same as that of the existing volute profile lines. In the volute of the present invention, in the axial direction of the impeller 22, the volute profile line is inconsistent at the volute tongue 214. With reference to FIGS. 4, 7 and 8, in this embodiment, the volute tongue 214 is disposed inclined. Specifically, the volute tongue 214 is gradually inclined from the rear cover 212 to the front cover 211 in a direction opposite to the rotation direction of the impeller 22. In the conventional range hoods, the volute tongue is perpendicular relative to the rear cover and the front cover, and the orthographic projection of the volute tongue on the cover plate is C-shaped. However, in the present invention, the projection of the volute tongue 214 on the front cover 211 is an inclined slope. With reference to FIGS. 8 and 12, the inclination direction of the volute tongue 214 is opposite to the air flow direction in the volute, so that the intersection of the volute tongue 214 with the front cover 211 extends in an upwind direction along the profile of the volute 21 (which can also be similar in shape), that is, the first end 213*a* of the annular wall 213 extends toward the connection of the inclined volute tongue 214 and the front cover 211 to form an extension portion 213*e*, so that length of the annular wall 213 at the first end 213*a* is increased (the edge line of the first end 213*a* of the annular wall 213 is inclined along the volute tongue 214). In FIG. 12, the dashed line is an auxiliary line perpendicular to the edge of the annular wall 213. One end of the dashed line is a starting end of inclination of the volute tongue 214, that is, the end close to the rear cover 212. In conventional range hoods, the first end 213*a* of the annular wall 213 terminates at the position shown by the dashed line. The extension portion 213*e* of the annular wall 213 in FIG. 12 is the extended part of the annular wall of the present invention. Thus, with reference to FIGS. 7 and 8, a narrow passage Q1 is formed between the extended annular wall 213 and the impeller 22, so that the flow rate is increased by using the passage Q1. A certain gas backflow is formed on the inner side of the front cover 211 of the volute 21 near the volute tongue 214. This gas backflow blows oil liquid flowing to the air outlet 216 on the inner side of the front cover 211 of the volute 21 to enter the passage Q1, then passes through the air inlet ring 217 at the air inlet 215, and gathers at the lowest position of a radial air guide portion 2171.

By moving the lower edge of the volute tongue 214 in the upwind direction, a narrow passage is formed to obtain a backflow gas so as to push the oil liquid to enter the air inlet ring 217. The upwind direction means that the extension direction of the volute tongue 214 is opposite to the rotation direction of the impeller 22. For example, when the impeller 22 rotates clockwise, the lower edge of the volute tongue 214 extends anticlockwise along the profile line of the volute 21. The volute profile line of the fan system is characterized in that the end close to the center is tangent to the volute tongue 214 and then gradually expands outward spirally. Therefore, the lower edge of the volute tongue 214 (close to the front cover 211) can be shrunk inward spirally, while the upper edge (close to the rear cover 212) remains the original design position of the volute tongue unchanged. If both the upper and lower edges are shrunk, a too small distance will be formed between the volute tongue 214 and the impeller 22, so that excessive gas backflow may result in abnormal howling sound. In addition, due to the gravity, the liquid will finally flow to the inner side of the front cover 211, so it is only necessary to shrink the junction of the front cover 211 and the volute tongue 214.

Specifically, as shown in FIGS. 7-11, the inclined extension of the volute tongue 214 means that the intersection of the annular wall 213 and the rear cover 212 is defined as a first profile line L1 of the volute 21, the intersection of the annular wall 213 and the front cover 211 is defined as a second profile line L2 of the volute 21, and the first profile line L1 and the second profile line L2 do not coincide at the volute tongue 214. In the first profile line L1, the radius at the ending point of the profile line of the volute tongue 214 is R1; and, in the second profile line L2, the radius at the ending point of the profile line of the volute tongue 214 is R2. That is, the ending of the profile line of the volute tongue 214 gradually extends toward the ending point of the volute profile line in a direction from the rear cover 212 to the front cover 211. The profile lines of the volute tongue 214 in the first profile line L1 and the second profile line L2 can be arc-sharped and equal in radius.

The ending point of the profile line of the volute tongue 214 in the first profile line L1 is defined as A. A point corresponding to A (that is, the point that coincides with the projection in the axial direction of the impeller 22 in the second profile line L2 is defined as B, the ending point of the profile line of the volute tongue 214 defined as C, and the second profile line L2 also has a radius of R1 at the point B. The line of BC in the second profile line L2 may be in arc-shape, a spiral line or is a reduced spline curve. When the line of BC in the second profile line L2 is a spiral line or other reduced spline curves, the passage Q1 is gradually narrowed from the point B to the point C, that is, in a direction opposite to the rotation direction of the impeller 22. That is, the part of the passage Q1 close to the cover plate 211 is narrower than the part of the passage Q1 close to the rear cover 212, thereby further increasing the flow rate.

Any point between B and C has a radius of Rx, and Rx satisfies the following condition: $R2 \leq Rx \leq R1$, and $0.75 \leq R2/R1 \leq 1$. Thus, the BC curve can be prevented from being shrunk too quickly to result in a too small distance between the volute tongue 214 and the impeller 22. In addition, the following condition also needs to be satisfied: $m \geq 2$ mm, where m is the distance between the point C and the edge of the impeller 22. This condition is similar to those for the existing fan systems.

In this embodiment, R2 is slightly smaller than (almost the same as) R1 and significantly larger than the reverse extension shape of the volute tongue profile line, that is, the BC curve is not rapidly shrunk spirally, thereby avoiding a too small clearance between the point C and the impeller 22. The straight line segment between the point C and the air outlet 216 of the second profile line L2 may be connected in a straight line, similar to a common volute profile line. The center point of the volute profile line is O (the center point of the first profile line L1 and the center point of the second profile line L2 coincide with each other, and the projections of the both in the axial direction of the impeller 22 are O), and an included angle θ is between the ligature BO and the ligature CO. The value range of θ is preferably 0° to 60°, more preferably 12.5° in this embodiment.

The housing 1 has an opening bottom, and the oil guide plate 3 is disposed below the fan system 2 to seal the bottom of the housing 1. The oil guide plate 3 can be connected and fixed to the housing 1 through a buckle 35. A fume suction port 31 is disposed at a position on the oil guide plate 3 corresponding to the air inlet 215, and a transition ring 32 is disposed at the fume suction port 31. The transition ring 32 comprises an annular radial air guide portion 321 extending in the radial direction of the edge of the fume suction port 31 and an axial air guide portion 322 extending from the radial inner side of the radial air guide portion 321 to the volute 21 in the axial direction of the impeller 22. The radial air guide portion 321 is cylindrical, and gradually extends from the radial inner side to the radial outer side in a direction away from the volute 21 (the fan system 2 is mounted downward) so that the longitudinal cross-section is arc-shaped. The axial air guide portion 322 axially extends into the volute 21 from the lowest position of the radial air guide portion 321. A filter screen 33 can be disposed at the fume suction port 31. In this embodiment, the filter screen 33 is an inverted pyramid.

During mounting, the axial air guide portion 322 of the transition ring 32 can extend into the volute 21 from the air inlet 215 of the volute 21. At this time, an air inlet seal ring 5 is disposed between the air inlet ring 217 of the volute 21 and the periphery of the oil guide plate 3 located outside the fume suction port 31. The oil guide plate 3, the volute 21 and the air inlet seal ring 5 can be locked by screws, so that a closed transition connection is formed between the fan system 2 and the oil guide plate 3, and it is ensured that the waste oil liquid in the oil guide plate 3 will not leak from the gap between the volute 21 and the oil guide plate 3.

In the above structure, the transition ring 32 on the oil guide plate 3 is equivalent to the air inlet ring of the conventional centrifugal fan. This structure in the present invention is different from the separate arrangement of the conventional air inlet ring at the air inlet 215 of the volute 21 (the separate arrangement will inevitably produce a fit clearance, resulting in different degrees of air leakage and water leakage). The transition ring 32 is protruded downward and the oil guide plate 3 is of a horizontal structure, so a gap in an arc-shaped racetrack shape is disposed on the annular surface at the lowest position of the transition ring 32. This structure is called an oil dripping port 34. The oil dripping port 34 extends in an arc shape in the radial direction of the transition ring 32. The air flow backflow blows the oil liquid in the front cover 211 to flow and makes the oil liquid have certain fluidity, so that the oil liquid can enter the oil dripping port 34 on the lowest annular surface. The radius of the oil dripping port 34 in the length direction is the same as the radium of the transition ring 32, so that all the waste oil liquid in the range hood can flow out from the oil dripping port 34.

A convex arc surface 323 is formed on the radial outer side of the transition ring 32 where the oil dripping port 34 is disposed. An end of the arc surface 323 is connected to the oil dripping port 34 and is not transited smoothly, and the adjacent end is an end that is most protruded downward. This end has the largest height difference with the same-diameter surface of the transition ring 32, and then radially approaches outward to the shape of the transition ring 32. The arc surface 323 is gradually transited to be partly connected to the oil guide plate 3 located on the edge of the fume suction port 31. The convex arc surface 323 can make an air flow smoothly pass by the oil dripping port 34 in a parabolic form without being sucked into the oil dripping port 34 to generate certain aerodynamic noise when the oil fume flow passes by the transition ring 32 to enter the air inlet 215 along the surface of the fan system 2 from inside to outside.

An oil liquid collection device is disposed below the oil guide plate 3. In this embodiment, the oil liquid collection device is a fume guide plate component 4 which comprises two fume guide plates 4 respectively corresponding to the fume suction ports 31 of the oil guide plates 3. The fume guide plates 41 can be connected to the oil guide plates 3 through the cooperation of hooks 43 with hangers 45 and through a clasp component 44, and can be detached relative to the oil guide plates 3. The connection between the fume guide plates 41 and the oil guide plates 3 can refer to some connection structures for the fume guide plate of the ceiling-mounted range hood involved in prior patents, for example, a Chinese Patent CN103697513A (Application No. 201310639355.0) (it is not limited to this patent). A small angle can be provided between the fume guide plates 41 and the oil guide plates 3. This angle is relatively small, so that the fume guide plates 41 and the oil guides plates 3 are kept in a parallel state. Each fume guide plate 41 is gradually inclined downward from front to rear, and the rear side of the fume guide plate 41 is protruded downward to form an oil collection groove 42. That is, the fume guide plate 41 can also be used as an oil cup. The left, right and front side edges of each fume guide plate 41 have a plurality of upward flanges 411, so that the fume guide plate 41 forms a container. Thus, the fume guide plate 41 can receive oil liquid dripping from the oil dripping port 34.

Figure 5:
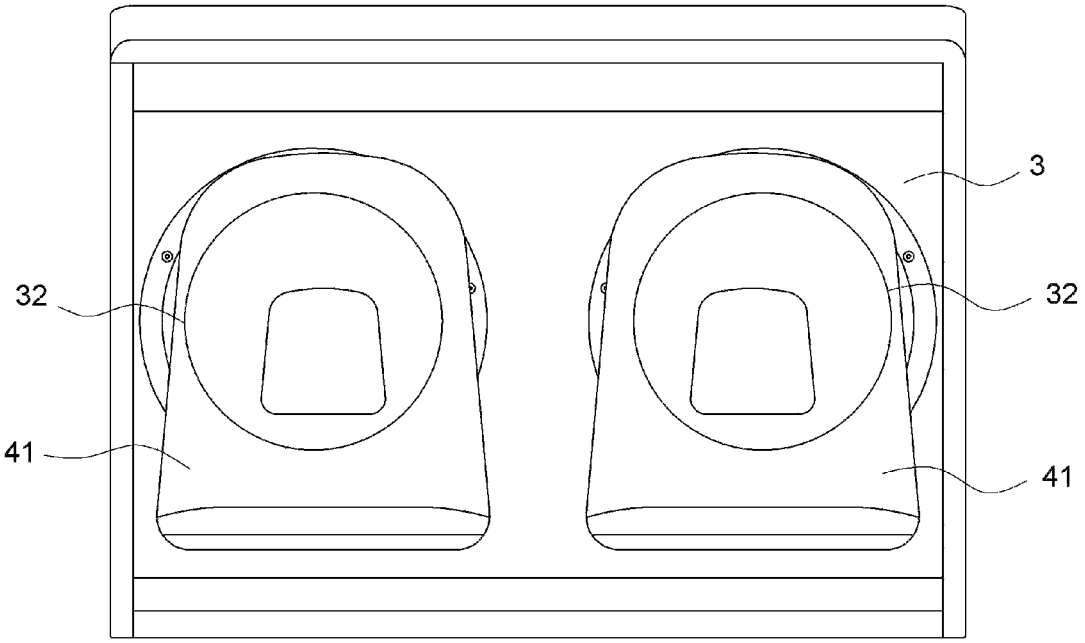
FIG. 5 is a bottom view of the range hood according to the embodiment of the present invention.
Figure 6:
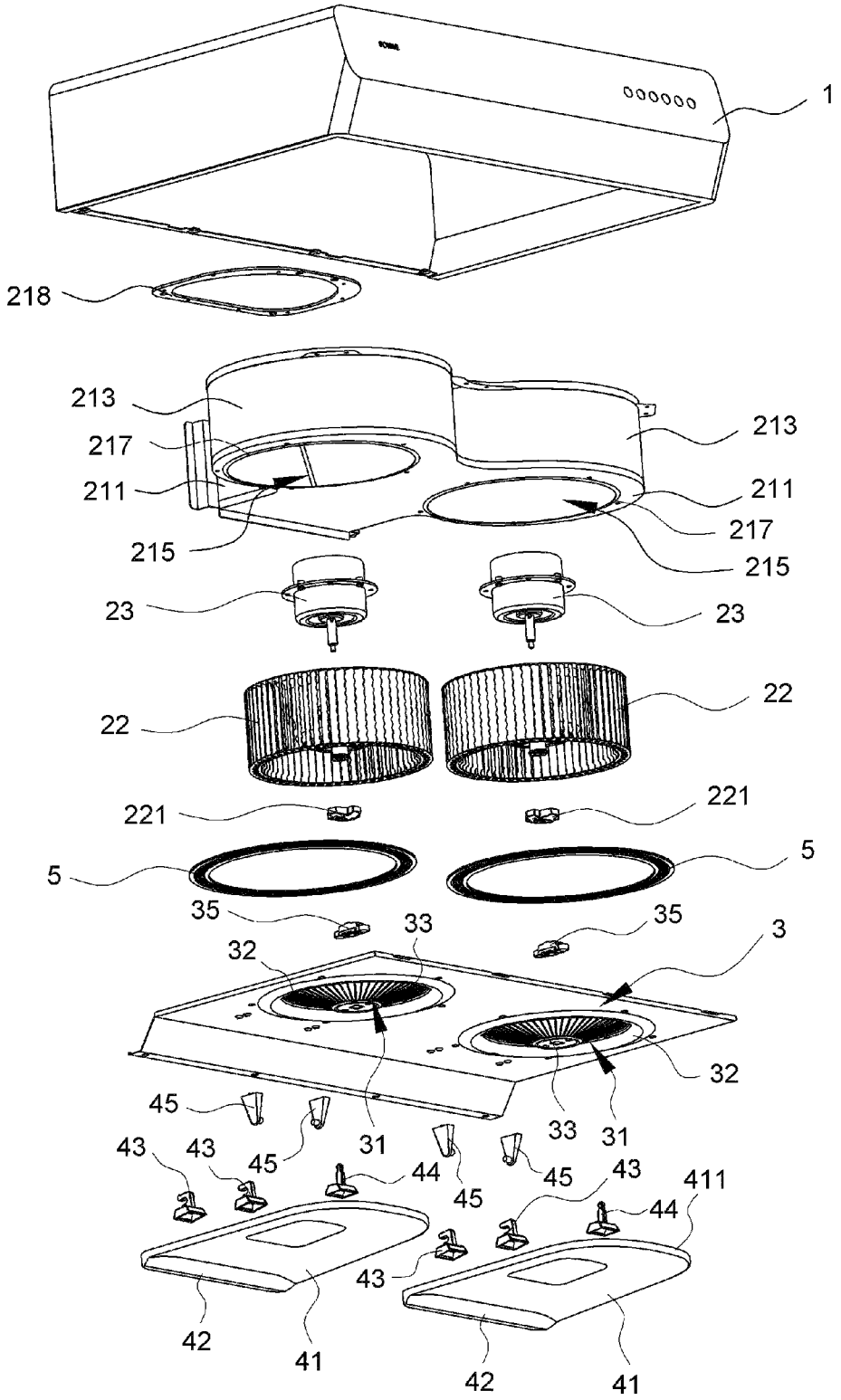
FIG. 6 is an exploded view of the range hood according to the embodiment of the present invention.

In addition, the periphery of the projection of the fume guide plate 41 on the horizontal plane is located on the periphery of the projection of the transition ring 32 of the oil guide plate 3 on the horizontal plane, with reference to FIG. 5, where the dashed line represents the projection of the transition ring 32 on the horizontal plane. The fume guide plate 41 and the oil guide plate 3 form an interlayer. This interlayer enables the negative pressure in the range hood to expand outward to the periphery of the fume guide plate 41, so that the oil fume can smoothly flow to the fume suction port 31 along the surface of the oil guide plate 3. Thus, an air flow at a certain flow rate is formed on the surface of the oil guide plate 3, thereby avoiding oil condensation on the surface of the oil guide plate 3. Since the fume suction port 31 is shaped as a circular structure, when the oil liquid flows through the transition ring 32 from the outer side of the oil guide plate 3 to enter the fume suction port 31, there is inevitably a problem that the inlet is shrunk, so that the oil liquid is directionally condensed on the outer surface of the transition ring 32 at the air inlet 215. Thus, the fume guide plate 41 can receive oil liquid droplets condensed on the lowest annular surface of the transition ring 32. The fume guide plate 41 collects the oil liquid dripping from the oil dripping port 34 and the outer surface of the transition ring 32, and gathers the oil liquid into the oil collection groove 42 on the rear side thereof. The user does not need to clean the fume guide plate 41 after each cooking, and just takes down the fume guide plate 41 and pours out the waste oil liquid after the oil liquid is accumulated to a certain degree.

What is claimed is:

1. A range hood, comprising a fan system (2) having a volute (21) and an impeller (22) disposed inside the volute (21);

wherein, the volute (21) comprises a front cover (211), a rear cover (212) and an annular wall (213) connected between the front cover (211) and the rear cover (212);

the annular wall (213) has a volute tongue (214);

the front cover (211) is located below the rear cover (212), the front cover (211) has an air inlet (215), the air inlet (215) faces downward to make the range hood to be a horizontal range hood;

wherein the volute tongue (214) is gradually inclined from the rear cover (212) to the front cover (211) in a direction opposite to the rotation direction of the impeller (22), an intersection of the annular wall (213) and the rear cover (212) is defined as a first profile line (L1) of the volute (21), an intersection of the annular wall (213) and the front cover (211) is defined as a second profile line (L2) of the volute (21);

an ending point of a profile line of the volute tongue (214) in the first profile line (L1) is defined as A, a point corresponding to A in the second profile line (L2) is defined as B, an ending point of the profile line of the volute tongue (214) in the second profile line (L2) is defined as C, and the line of BC is in arc-shape or is a reduced spline curve, in the first profile line (L1), the radius at the ending point of the profile line of the volute tongue (214) is defined as R1, in the second profile line (L2), the radius at the ending point of the profile line of the volute tongue (214) is defined as R2;

any point between B and C has a radius of Rx, and $R2 \leq Rx \leq R1$, and $0.75 \leq R2/R1 \leq 1$.

2. The range hood of claim 1, wherein projections of center points of the first profile line (L1) and the second profile line (L2) in an axial direction of the impeller (22) are O;

an included angle θ is defined between the ligature BO and the ligature CO, and the included angle θ is in a range of 0° to 60°.

3. The range hood of claim 1, wherein the range hood further comprises a housing (1) having an opening bottom;

wherein the fan system (2) is disposed in the housing (1);

an oil guide plate (3) is disposed below the fan system (2) to seal a bottom of the housing (1);

a fume suction port (31) is disposed at a position on the oil guide plate (3) corresponding to the air inlet (215);

a transition ring (32) for guiding air flow into the air inlet (215) of the volute (21) is disposed at the fume suction port (31); and the transition ring (32) extends into the volute (21) from the air inlet (215).

4. The range hood of claim 3, wherein the transition ring (32) comprises an annular radial air guide portion (321) extending in a radial direction of an edge of the fume suction port (31) and an axial air guide portion (322) extending from a radial inner side of the radial air guide portion (321) to the volute (21) in the axial direction of the impeller (22); and the axial air guide portion (322) extends into the volute (21) from the air inlet (215) of the volute (21).

5. The range hood of claim 4, wherein the radial air guide portion (321) is cylindrical and gradually extends from a radial outer side to a radial inner side in a direction away from the volute (21) and a longitudinal cross section is arc-shaped;

the axial air guide portion (322) axially extends into the volute (21) from the lowest position of the radial air guide portion (321); and an oil dripping port (34) is disposed on an annular surface at the lowest position of the transition ring (32).

6. The range hood of claim 5, wherein a convex arc surface (323) is formed on a radial outer side of the transition ring (32) where the oil dripping port (34) is disposed;

an end of the arc surface (323) is connected to the oil dripping port (34);

the arc surface (323) is gradually transited to be partly connected to the oil guide plate (3) located on the edge of the fume suction port (31); and the end of the arc surface (323) connected to the oil dripping port (34) is the lowest position of the whole arc surface (323).

7. The range hood of claim 3, wherein an air inlet ring (217) is disposed at the air inlet (215) on the front cover (211), and the air inlet ring (217) extends inward radially from an edge of the air inlet (215) and gradually extends toward the outside of the volute (21) to form an inclined ring structure.

8. The range hood of claim 7, wherein an air inlet seal ring (5) is disposed between the air inlet ring (217) of the volute (21) and the periphery of the oil guide plate (3) located outside the fume suction port (31).

9. The range hood of claim 3, wherein a fume guide plate (41) is disposed below the oil guide plate (3), and the fume guide plate (41) is disposed below the fume suction port (31).

10. The range hood of claim 9, wherein a periphery of a projection of the fume guide plate (41) on a horizontal plane is located on the periphery of the projection of the transition ring (32) of the oil guide plate (3) on the horizontal plane.

11. The range hood of claim 10, wherein the fume guide plate (41) is gradually inclined downward from front to rear, and the rear side of the fume guide plate (41) is protruded downward to form an oil collection groove (42).

12. The range hood of claim 11, wherein left, right and front side edges of the fume guide plate (41) have a plurality of upward flanges (411).

* * * * *